United States Patent [19]

Johnston

[11] Patent Number: 4,570,855

[45] Date of Patent: Feb. 18, 1986

[54] SPRAYING APPARATUS

[76] Inventor: Taylor C. Johnston, P.O. Box 55-7544, Miami, Fla. 33155

[21] Appl. No.: 600,079

[22] Filed: Apr. 13, 1984

[51] Int. Cl.[4] ..... A62C 13/60

[52] U.S. Cl. ..... 239/195; 239/304; 239/375

[58] Field of Search ..... 239/303, 304, 305, 307, 239/308, 195, 375; 222/399

[56] References Cited

U.S. PATENT DOCUMENTS

| | | | |
|---|---|---|---|
| 2,504,487 | 4/1950 | Anson | 222/399 X |
| 2,886,689 | 5/1959 | Garth | 239/304 X |

FOREIGN PATENT DOCUMENTS

| | | | |
|---|---|---|---|
| 2439086 | 8/1974 | Fed. Rep. of Germany | 239/303 |
| 2635531 | 8/1976 | Fed. Rep. of Germany | 239/305 |
| 1070911 | 2/1953 | France | 239/305 |

*Primary Examiner*—Jeffrey V. Nase
*Assistant Examiner*—David P. Davidson
*Attorney, Agent, or Firm*—Oltman and Flynn

[57] ABSTRACT

An apparatus for spraying both liquid and dry particulate material such as powder. A rectangular housing holds upright cylinders, one for liquid and the other for dry particulate material and each having a one-way check valve at the top for receiving pressurized air and an air pressure gauge above the housing. Coiled flexible hoses extend from the respective cylinders to spray nozzles outside the housing. This entire assembly is stored in a covered carrying case.

9 Claims, 11 Drawing Figures

58
80
81
61
60
62
59
57

57
61
POISON
60
59
10
10
58

56
56
57
61
62
60
81
33
58
28
21
22
25
53
43
42
41
51
16
14
17

SPRAYING APPARATUS

SUMMARY OF THE INVENTION

This invention relates to an apparatus for selectively spraying a liquid and a dry particulate material such as a powder.

In accordance with a presently preferred embodiment of this invention, a single housing holds a first cylinder filled with a liquid and a second cylinder filled with a dry powder, both extending upright in the housing. At the top of each cylinder is a one-way check valve enabling pressurized air to be introduced. At its upper end the interior of the dry powder cylinder is connected to a helically wound hose. At its lower end the interior of the liquid cylinder is connected to a helically wound hose which is normally stored inside the housing and is attached to a spray nozzle. Each cylinder has a pressure gauge for indicating the air pressure inside. A safety valve is attached to each cylinder to prevent accidental over pressurization. The apparatus is inside a covered carrying case with a small door in the top which enables the user to reach in and grasp either spray nozzle to remove it from the carrying case and unwind the hose connecting it to the corresponding cylinder. When the spray nozzle is turned on, the air under pressure in the corresponding cylinder forces the material (either liquid or dry particles) out of that cylinder and through the corresponding hose to the nozzle.

A principal object of this invention is to provide a novel apparatus for spraying either a liquid or a dry powder.

Another object of this invention is to provide a novel apparatus of this type which is safe and easy to use.

Further objects and advantages of this invention will be apparent from the following detailed description of a presently preferred embodiment which is illustrated schematically in the accompanying drawings.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

Figure 3:
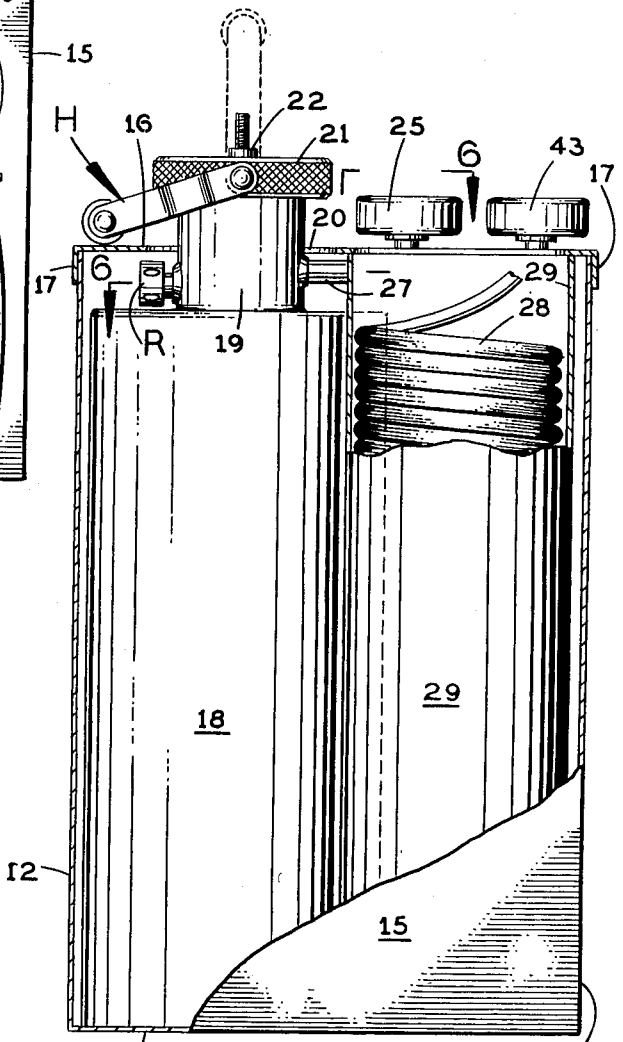
FIG. 3 is an end elevation taken from the right end of FIG. 1 and with the housing broken away.
Figure 1:
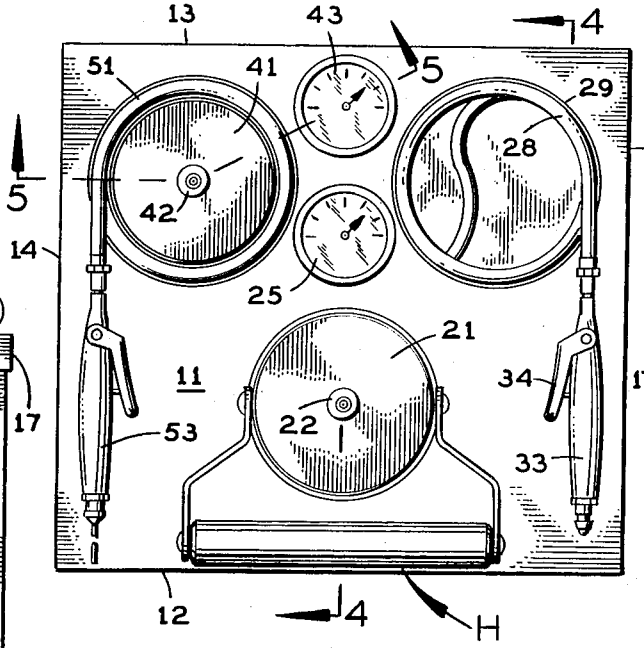
FIG. 1 is a top plan view of the present invention with the top cover removed.
Figure 2:
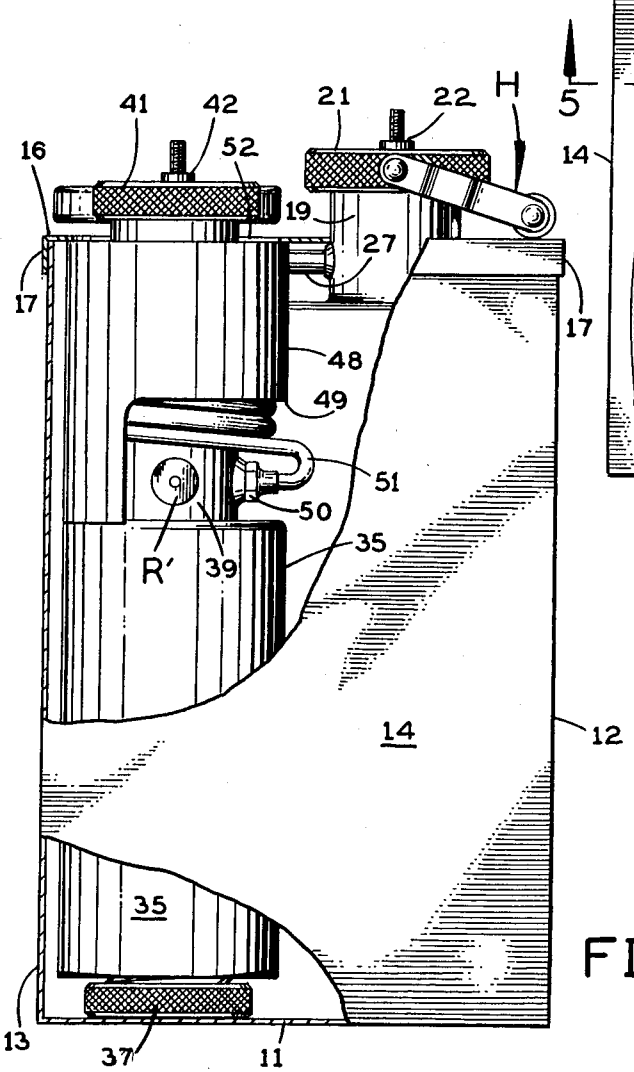
FIG. 2 is an end elevation taken from the left end of FIG. 1 and with part of the housing broken away.

Referring to FIGS. 2 and 3, the present apparatus includes a rectangular sheet metal housing having a flat bottom wall 11, upstanding front and rear walls 12 and 13 which extend up from the bottom wall, upstanding opposite end walls 14 and 15 (FIG. 1) extending up from the bottom wall and between the front and rear walls. The housing has a flat top cover 16 with a depending peripheral flange 17 which fits snugly around the front, rear and end walls at their upper ends.

Figure 4:
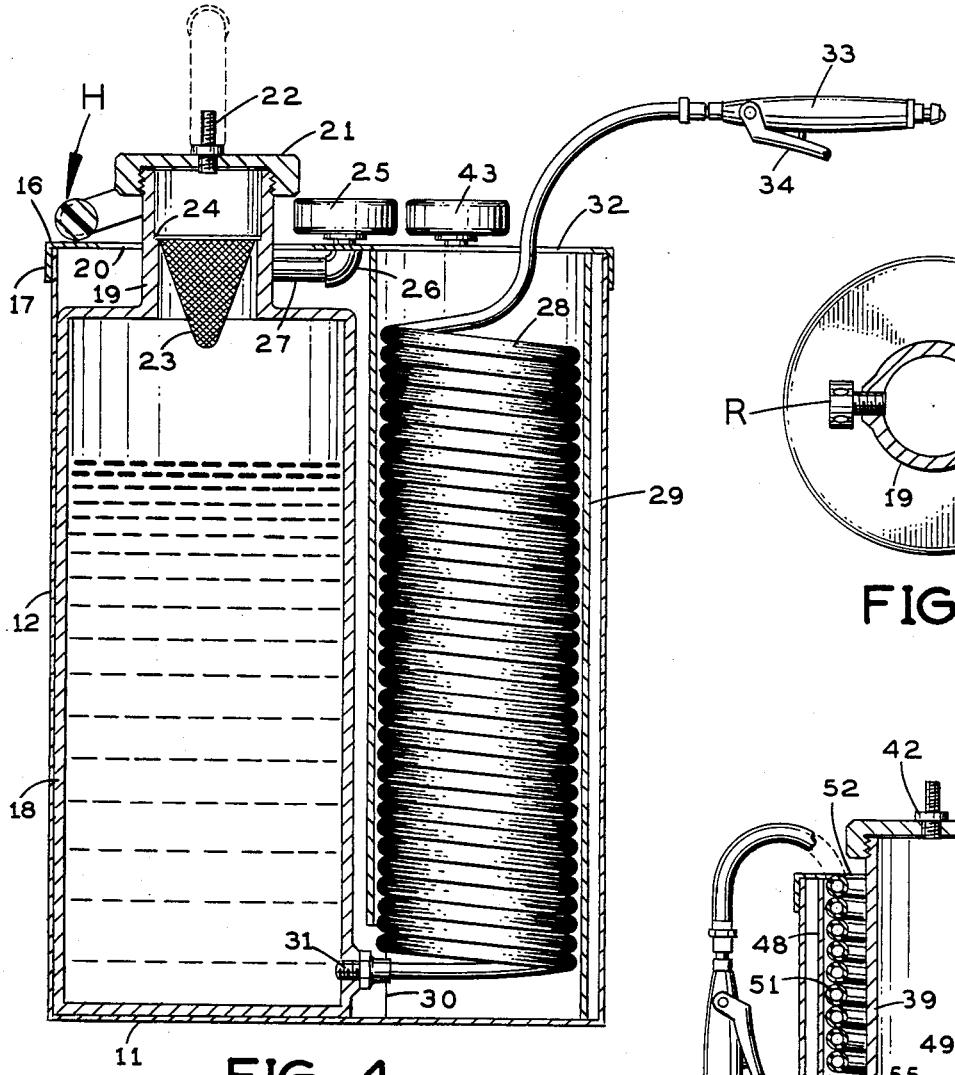
FIG. 4 is a vertical cross-section taken along the line 4—4 in FIG. 1.
Figure 6:
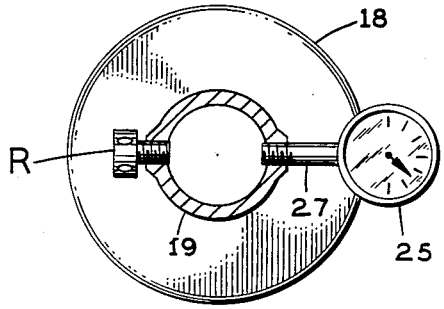
FIG. 6 is a view taken along line 6—6 in FIG. 3.

A first cylinder 18 (FIGS. 1 and 3) for holding liquid rests on the bottom wall 11 of the housing and extends up inside the housing next to the front wall 12 almost to the top cover 16. The cylinder 18 has a cylindrical neck 19 of reduced diameter at the top which extends up through an opening 20 in the top cover. This neck is externally threaded at its upper end and an internally screw threaded end cap 21 (FIGS. 1, 3 and 4) threadly engages this part of the neck. This end cap has a oneway check valve 22 for passing pressurized air into the cylinder 18 at the top. A funnel-shaped liquid strainer 23 rests on an internal, upwardly-facing, annular shoulder in the cylinder neck 19. A first pressure gauge 25 mounted on the top cover 16 communicates with the interior of cylinder 18 through an elbow 26 and a short pipe 27 leading into the interior of cylinder neck 19 a short distance below shoulder 24. A pressure relief valve R (FIG. 6) communicates with the interior of the cylinder neck 19 directly opposite the pipe 27. A pivoted handle H on the end cap 21 enables cylinder 18 to be inserted down into the housing or removed from it conveniently.

A spirally wound, flexible hose 28 is located inside a cylindrical partition 29 which extends from the bottom wall 11 up to the top cover 16 of the housing near the corner between housing walls 13 and 15 (FIG. 1). The lower end of this hose extends through an opening 30 in this partition to a fitting 31 which provides fluid communication between the hose and the interior of cylinder 18 just above its bottom wall. The hose 28 extends up in a closely wound helix against the inside of partition 29 and passes through an opening 32 in the top cover 26 to a spray nozzle 33 of known design having a pivoted operating handle or trigger 34.

Figure 5:
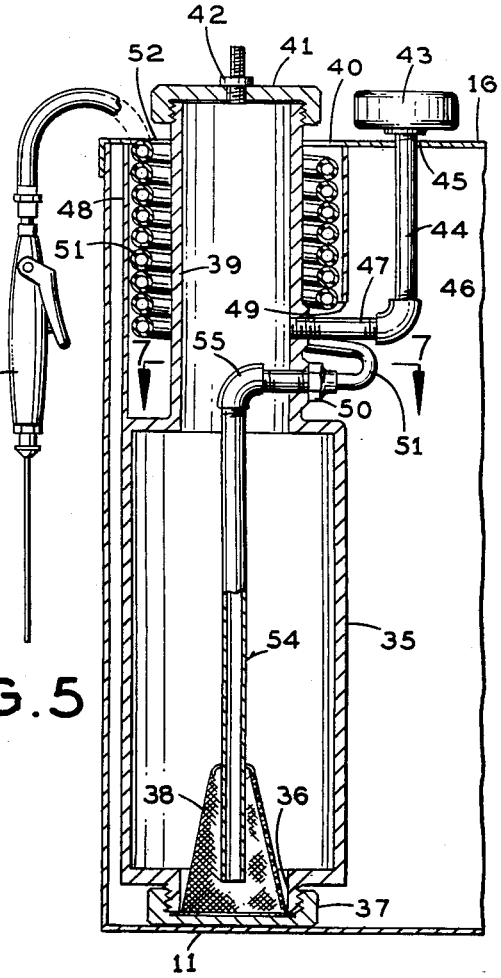
FIG. 5 is a vertical cross-section taken along the line 5—5 in FIG. 1.

A second cylinder 35 (FIG. 2) holding a particulate material such as powder or dust extends up inside the housing near the corner between walls 13 and 14. As shown in FIG. 5, this cylinder has a downwardly projecting, reduced diameter neck 36 at its lower end which is externally screw-threaded. An internally screw-threaded end cap 37 on this neck engages the bottom wall 11 of the housing. An inverted funnel-shaped strainer 38 extends up from this end cap through the neck 36 into the cylinder 35.

Figure 7:
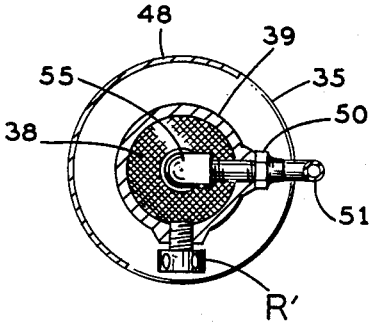
FIG. 7 is a horizontal cross-section taken along the line 7—7 in FIG. 5.
Figure 11:
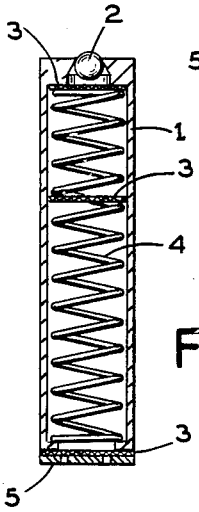
FIG. 11 shows the inside of a nozzle.

The cylinder 35 has a cylindrical segment 39 of reduced diameter at its upper end which passes through an opening 40 in the top cover 16 of the housing. This reduced segment of the cylinder is externally screw-threaded at its upper end and an end cap 41 is threadedly mounted on it. This end cap carries a one-way check valve 42 for passing pressurized air into the upper end of this cylinder. A second pressure gauge 43 is located directly above the top cover 16 of the housing. This gauge is on the upper end of a vertical pipe 44 extending down through an opening 45 in the top cover and connected by an elbow 46 to a horizontal pipe 47 mounted on the reduced upper end segment 39 of cylinder 35 and communicating with the interior of this segment of the cylinder. A pressure relief valve R' (FIG. 7) communicates with the interior of this cylinder at a location a short distance below pipe 47 and 90 degrees from it circumferentially of the reduced upper end 39 of the cylinder.

Cylinder 35 has an upwardly extending cylindrical wall 48 which for most of its vertical extent encircles the reduced upper end segment 39 of this cylinder. This wall has an opening 49 at one side whose upper edge is a short distance above pipe 47, as shown in FIG. 5. A fitting 50 is threadedly mounted in the upper end segment 39 of cylinder 35 a short distance below pipe 47. A flexible hose 51 is attached at its lower end to this fitting and extends in a succession of closely spaced helical turns up through the annular spaced between wall 48 and the reduced upper end segment 39 of the cylinder, passing out through an opening 52 in the top cover 16 of the housing and having its upper end connected to a spray nozzle 53. Inside the wider lower end of cylinder 35, a vertical pipe 54 extends up from inside the strainer 38 to an elbow 55 leading to fitting 50. The lower end of pipe 54 is spaced above the end cap 37 on cylinder 35 so that the powder can flow from the inside of this cylinder at its lower end up through pipe 54 to hose 51 and nozzle 53. Inside the nozzle is a dust filter and particle sizer 1. The dust passes through the nozzle through a ball bearing check valve 2 and then through filtering screens 3 placed within a retaining spring 4. At the end of the filter and particle sizer is disc and filter orifice 5. The two safety valves R and R' prevent over-pressurization.

Cylinder 18 may, for example, hold liquid insecticide and cylinder 35 may hold powdered insecticide.

Figures 8, 9, 10:
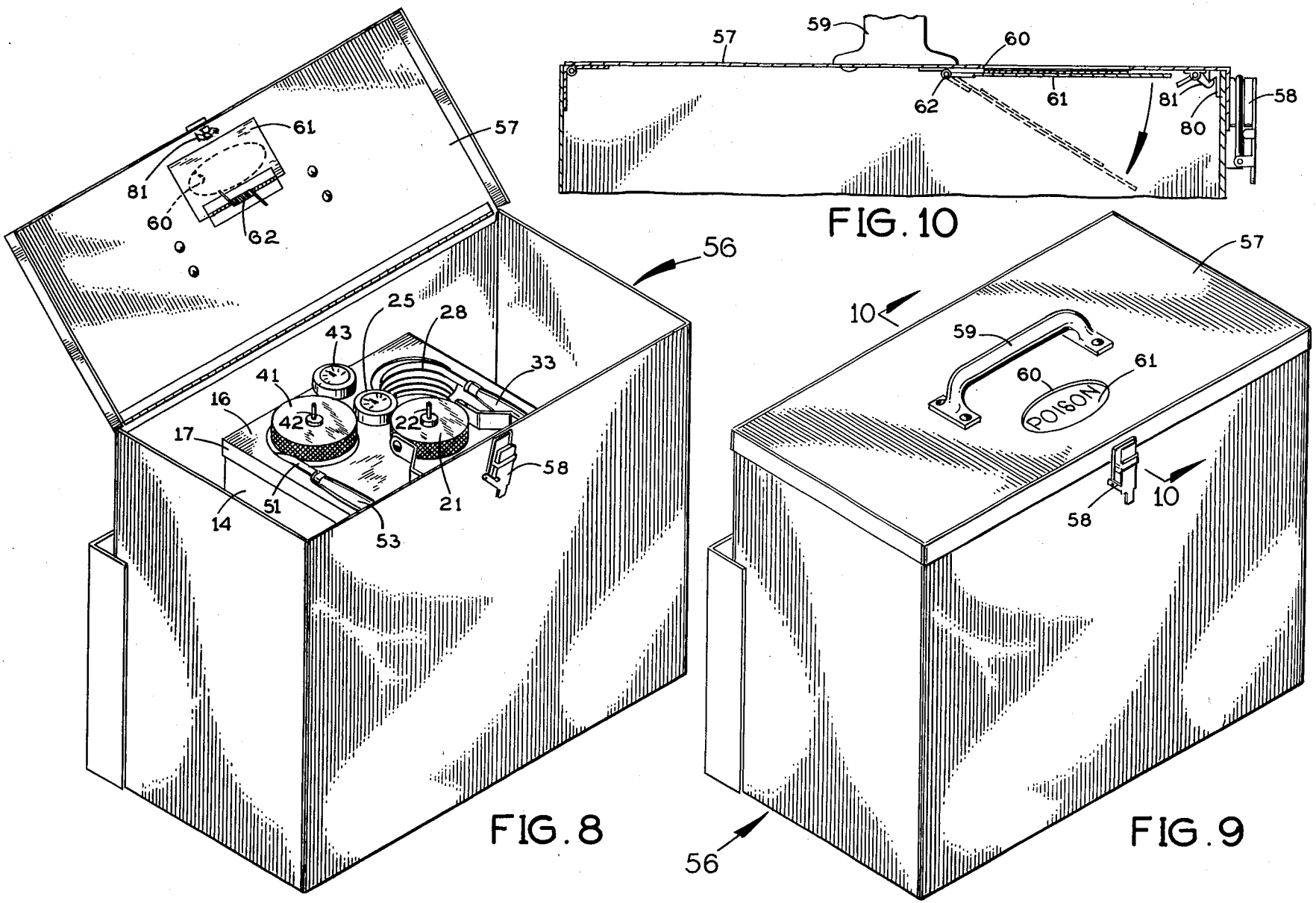
FIG. 8 is a perspective view showing the apparatus of FIGS. 1–7 in a carrying case with its top open.
FIG. 9 is a view similar to FIG. 8 but with the top of the carrying case closed.
FIG. 10 is a section taken along the line 10—10 in FIG. 9.

The apparatus described thus far may be put inside a rectangular case 56 as shown in FIGS. 8, 9 and 10. This case has a hinged top cover 58 which normally is held closed (FIG. 9) by a latch 58, of known design, on the front of the case. The top cover has a centrally located handle 59 enabling it to be carried by one man.

In front of this handle the top cover has an elliptical opening 60 which is normally closed from below by a hinged door 61. A coiled torsion spring 62 biases door 61 to its closed position.

A catch 80 mounted on the top cover is engageable with a spring biased keeper 81 to lock the cover. The safety catch 80 can be released by pushing down on the door 61 and inserting the fingers to push back the keeper 81.

In the use of this apparatus, after partially filling cylinder 18 with fluid and cylinder 35 with particulate, the cylinders may be pressurized by attaching a source of compressed air to the respective check valves 22 and 42 and detaching it when the corresponding pressure gauge 25 or 43 shows that the cylinder has the desired air pressure. Preferably, this pressurization is done while the apparatus is in the case 56 with its top cover 57 open, as shown in FIG. 8. Then this top cover is closed and the apparatus is transported to the site where spraying is to be done.

I claim:

1. A spraying apparatus comprising:

a housing;

a first cylinder for liquid extending upright in said housing and having a top end cap above said housing, a one-way check valve in said end cap for passing pressurized air into said cylinder above the liquid therein;

a partition extending cylindrically up inside said housing;

a flexible first hose operatively connected to the interior of the first cylinder adjacent its lower end and extending up inside said partition in closely spaced helical turns and passing through the top of said housing, a first discharge nozzle connected to said hose outside said housing;

a second cylinder for particulate material such as powder extending upright in said housing, said second cylinder having a reduced diameter segment at its upper end inside said housing, an annular partition extending around said reduced diameter segment of the second cylinder and defining therewith an annular space, a top end cap on said reduced segment of the second cylinder above said housing, a one-way check valve in said last-mentioned end cap for passing pressurized air into said second cylinder above the particulate therein;

and a flexible second hose having opposite ends, one of which is located in the interior of the second cylinder at the lower end of the latter, said second hose extending in closely spaced helical turns up inside said annular spaced and passing through the top of said housing, and a second discharge nozzle connected to the opposite end of said second hose outside said housing.

2. An apparatus according to claim 1 and further comprising:

a first pressure gauge above said housing operatively connected to said first cylinder to display the air pressure therein;

and a second pressure gauge above said housing operatively connected to said second cylinder to display the air pressure therein.

3. An apparatus according to claim 2 and further comprising:

a carrying case holding said housing, said carrying case having a top cover with an opening therein;

a lock under said opening;

and a door normally closing said opening and operative to be opened manually to provide access to said lock.

4. An apparatus according to claim 3 and further comprising:

a pipe extending down inside said second cylinder and having an inlet opening at its lower end;

and means operatively connecting the upper end of said pipe to the lower end of said second hose.

5. An apparatus according to claim 4 and further comprising:

a strainer surrounding said inlet opening at the lower end of said pipe.

6. An apparatus according to claim 5 and further comprising:

a strainer in the upper end of said first cylinder directly below its top end cap.

7. An apparatus according to claim 1 and further comprising:

a pipe extending down inside said second cylinder and having an inlet opening at its lower end.

8. An apparatus according to claim 7 and further comprising:

a strainer surrounding said inlet opening at the lower end of said pipe.

9. An apparatus according to claim 1 and further comprising:

a strainer in the upper end of said first cylinder directly below its top end cap.

* * * * *